United States Patent [19]

Rabey et al.

[11] Patent Number: 4,705,921

[45] Date of Patent: Nov. 10, 1987

[54] PATCH MODULE

[75] Inventors: Alexander Rabey, Hatboro; Herbert J. Hampel, Feasterville, both of Pa.

[73] Assignee: VIR, Inc., Southampton, Pa.

[21] Appl. No.: 901,053

[22] Filed: Aug. 26, 1986

[51] Int. Cl.[4] ..... H01H 9/20; H01R 33/96

[52] U.S. Cl. ..... 200/50 B; 200/51.09; 200/51.1

[58] Field of Search ..... 200/16 C, 16 D, 51 R, 200/51.03, 51.07, 51.09, 51.1, 50 R, 50 A, 50 B, 1 R, 153 LA, 153 L, 292; 339/17 L, 75 M, 75 MP

[56] References Cited

U.S. PATENT DOCUMENTS

| | | | |
|---|---|---|---|
| 3,588,399 | 6/1971 | Viosca, Jr. | 200/51.1 |
| 3,609,462 | 9/1971 | DeBarros | 361/415 |
| 4,034,170 | 7/1977 | Raabe et al. | 200/50 A |
| 4,037,186 | 7/1977 | Palmer et al. | 335/206 |
| 4,047,782 | 9/1977 | Yeager | 339/75 MP |
| 4,053,724 | 10/1977 | Llona | 200/51 R |
| 4,071,722 | 1/1978 | Hart | 200/50 A |
| 4,112,401 | 9/1978 | Palmer et al. | 335/206 |
| 4,118,094 | 10/1978 | Key | 339/75 MP |
| 4,140,918 | 2/1979 | Lancaster | 307/112 |
| 4,154,994 | 5/1979 | Seiden et al. | 200/51.07 |
| 4,237,352 | 12/1980 | Seiden | 200/51.03 |
| 4,238,655 | 12/1980 | Vonder | 200/153 LA |
| 4,256,936 | 3/1981 | Lancaster | 200/51.07 |
| 4,363,941 | 12/1982 | Nelson | 200/1 R |
| 4,460,811 | 7/1984 | Murr et al. | 200/51.03 |
| 4,476,357 | 10/1984 | Malmborg et al. | 200/51.09 |
| 4,504,101 | 3/1985 | Reimer | 339/17 L |

*Primary Examiner*—J. R. Scott

*Attorney, Agent, or Firm*—William H. Eilberg

[57] ABSTRACT

A patch module is disclosed, into which a plug can be easily inserted. In the preferred embodiment, the patch module has two sets of receptacles, the first set having three receptacles and the second set having two receptacles. Both sets are mounted on a printed circuit board which makes the desired electrical connections. The first receptacle of the first set is permanently connected to the first receptacle of the second set. The second receptacle of the first set is permanently connected to the second receptacle of the second set. The conductors of the first and second receptacles of the second set are normally connected together by contacts on a spring-biased, slidable panel, the panel being mounted for movement along the circuit board. When a plug is inserted into one of the first two receptacles of the first set, the panel slides to its other position, breaking the connection between the first and second receptacles of the second set. The panel slides in a direction generally perpendicular to that of the plug, through the cam action of a tab which is pushed by the plug. While being inserted, the plug travels a greater distance than the distance traveled by the panel, thus creating a mechanical advantage. The plug can easily be inserted against the spring force, and a simple latch is sufficient to insure that the spring-biased panel will not push the plug out of its socket.

22 Claims, 5 Drawing Figures

PATCH MODULE

BACKGROUND OF THE INVENTION

This invention discloses a patch module, which is used for making and breaking various connections between the conductors of electrical receptacles.

The invention is particularly useful in the fields of computers and telecommunications. A computer is typically connected to a modem, which permits the computer to transmit and receive data through ordinary telephone lines. The cables used in the computer industry usually have 25 conductors, and these cables are connected to suitable plugs, which are inserted into appropriate receptacles. It is often necessary, for diagnostic purposes, or for other reasons, to break the connection between the computer and the modem, and to connect a new modem to the computer, or vice versa. A patching module, such as the one disclosed herein, will make and break these connections as required, while minimizing unnecessary plugging and unplugging of equipment.

One example of a patching device of the prior art is shown in U.S. Pat. No. 4,037,186, the disclosure of which is incorporated by reference herein. In the patented device, the conductors of a pair of receptacles are normally connected together by the wiring configuration on a printed circuit board, and by the action of a slidable panel, mounted for movement along the board. The panel contains a plurality of magnets which, when brought into proximity with small reed switches on the board, cause those switches to close, and the switches then complete the desired electrical connections.

The panel, in the cited patent, is spring-biased so that as long as a patching plug has not been inserted into the device, the first pair of receptacles remain connected together. But when a plug is inserted into the patch receptacle, the plug pushes against the panel, and causes the panel to slide, breaking the connection between the normally-connected conductors. The patch receptacle is connected to one of the first pair of receptacles. Thus, the patented patch module allows the user to "patch" a piece of equipment to one or the other of a pair of devices, while simultaneously breaking the connection between those devices.

Another example of a patch module is given in U.S. Pat. No. 4,154,994, the disclosure of which is also incorporated by reference herein. The patch module in the latter patent performs a similar function to that of the patent cited earlier, but uses a different structure for making and breaking the connections.

Still another patch module is shown in U.S. Pat. No. 4,363,941. The latter patent shows a patch structure intended to reduce the wear on the contacts. The disclosure of this patent is also incorporated by reference herein.

In U.S. Pat. No. 4,037,186, cited above, there is relatively little friction between the sliding panel and the printed circuit board. This is because the connections are completed by the magnetically operated switches, and the magnets need not touch the connections on the board. Since there is very little contact between the panel and the board, the panel slides very easily, and the force needed to insert the plug is relatively low. However, there are disadvantages in using magnetic switches. Not only do they add to the complexity of the device, but they are also subject to interference from stray magnetic fields.

If the magnetic switches of U.S. Pat. No. 4,037,186 are replaced by ordinary contacts, then the friction between the panel and the circuit board becomes much greater. It then becomes necessary to use more force in inserting the plug, and it is also necessary to use a heavier spring. In the devices of the prior art, the plug is inserted in such a manner that it pushes directly against the panel.

It is important not only that the plug be easily inserted into its socket, but also that the plug remain in the socket until pulled out. In devices of the prior art which use a heavy spring that pushes the panel directly against the plug, it is necessary to use a rugged latching mechanism to retain the plug in the socket.

The present invention provides an improved patch module wherein a patching plug can be inserted with relatively little effort. In effect, the plug has a mechanical advantage, against the force of the sliding panel. The present invention also needs only the simplest of latching devices to insure that the plug remains in its socket. The patch module of the present invention is therefore simpler to construct, and more reliable in operation, than the patch devices of the prior art.

SUMMARY OF THE INVENTION

In the preferred embodiment of the present invention, the patch module has two sets of receptacles, mounted on a printed circuit board. The first set preferably has three receptacles, and the second set has two receptacles. The conductors of the second set are normally connected together; this connection can be broken in the manner described below. Typically, a computer and its modem could be connected to the receptacles of the second set. The first set constitutes the patching receptacles, i.e. the receptacles through which additional equipment can be "patched" to the devices of the second set.

The first receptacle of the first set is permanently connected, through the printed circuit board, to the first receptacle of the second set. The second receptacle of the first set is also permanently connected, through the printed circuit board, to the second receptacle of the second set. The third receptacle of the first set is permanently connected to the second receptacle of the first set, also through connections on the printed circuit board, and is intended for use in monitoring the line which is connected to the second receptacles.

The conductors of the first and second receptacles of the second set are normally connected together. The connection is made, in part, by conductors on the printed circuit board, and is completed by contacts disposed on a slidable panel, mounted for movement on the board. The panel is spring-biased such that, when no patching plug has yet been inserted into the first or second receptacles of the first set, the contacts of the panel are positioned to maintain the connection between the first and second receptacles of the second set.

When a plug is inserted into either or both of the first two receptacles of the first set, the plug pushes a tab means onto a cam surface defined by the panel. The pressure of the tab means is diverted by the cam surface so that the panel moves in a direction generally perpendicular to that of the incoming plug. When the panel moves, its contacts also move, and the connection between the receptacles of the second set is broken. Thus, the device attached to the patching plug becomes "patched" to one of two devices which were previously connected together. At the same time, the connection between those two devices is broken.

The panel moves in the desired direction due to pressure of the tab means on a beveled surface formed on the panel. The arrangement is such that the force on the plug is never exerted directly against the spring which biases the panel in its normal position. The cam surfaces are such that the incoming plug moves a greater distance, while pushing against the panel, than does the panel. In this way, there is a mechanical advantage, by which the plug overcomes the spring force of the panel. There is also a simple latch which engages a groove on the plug, preventing the panel from dislodging the plug from its socket.

It is therefore an object of the present invention to provide a patch module wherein a patching plug can be easily inserted, and wherein the plug cannot easily become dislodged from its socket.

It is another object of the invention to provide a patch module wherein the patching plug uses a mechanical advantage to overcome the force of a spring biased panel.

It is another object of the invention to provide a patch module which does not require an elaborate latching mechanism for the plug.

It is another object of the invention to provide a patch module of simplified construction.

It is another object of the invention to reduce the cost of making a patch module.

It is another object of the invention to provide a patch module which enables a piece of equipment to be easily and quickly connected to either of a pair of devices, while the connection between those devices is simultaneously broken.

It is another object of the invention to provide a patch module having a circuit-disconnecting means which moves in a different direction from that of the incoming patching plug.

Other objects and advantages of the invention will be apparent to those skilled in the art, from a reading of the following brief description of the drawings, the detailed description of the invention, and the appended claims.

DETAILED DESCRIPTION OF THE INVENTION

The electrical connections made by the patch module of the present invention can best be explained with reference to the schematic diagram of FIG. 4. Throughout the specification and claims, the term "first set of receptacles" refers to the receptacles illustrated at the left in FIG. 4, and designated as A, B, and C. The term "second set of receptacles" refers to the two receptacles at the right in FIG. 4, and which are designated as 1 and 2.

Figure 4:
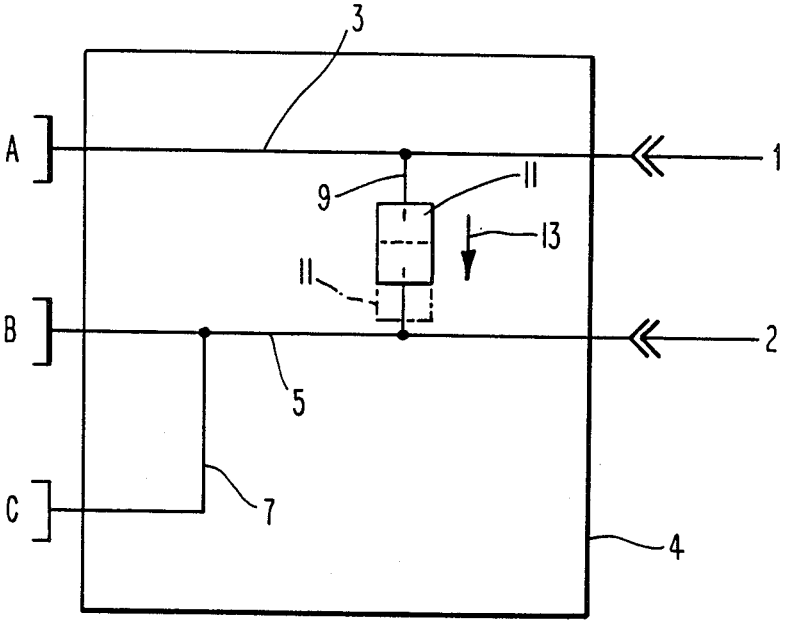
FIG. 4 is a schematic diagram of the patch module of the present invention, showing the electrical connections made and broken by the sliding panel.

In FIG. 4, only a single line is used to indicate connections between receptacles, but it is understood that each line may, in general, represent a plurality of separate conductors. Also, when the specification states that, say, receptacle 1 is connected to receptacle 2, it is understood that this expression means that each conductor of one receptacle is connected to the corresponding conductor of the other receptacle. As stated above, in computer technology, it is common to use connectors having 25 conductors. The lines in FIG. 4 can represent any number of such conductors.

Box 4 schematically designates the printed circuit board which contains most of the connections indicated in the schematic diagram. As shown in FIG. 4, the printed circuit board is "hard wired" such that receptacle A is permanently connected to receptacle 1, by line 3. Similarly, receptacle B is permanently connected to receptacle 2, by line 5. Also, receptacle C is permanently connected to receptacle B, by line 7. Receptacle C is intended for monitoring purposes only. A device plugged into receptacle C will monitor the line, through its connection to receptacles B and 2.

Receptacles 1 and 2 are normally connected together through line 9 and slidable contact 11. When a plug is inserted into either receptacle A or receptacle B, or both, contact 11 is made to slide in the direction indicated by arrow 13, into the position indicated in dotted outline, breaking the connection between receptacles 1 and 2. Details of the mechanical mechanism which causes the contact to slide are given below.

While the invention is described with respect to a particular number of receptacles, it is understood that this embodiment is merely exemplary, and not limiting. There need not be exactly three receptacles in the first set of receptacles. There could be as few as one receptacle A in this first set. FIG. 4 shows only two receptacles (A and B) in the first set, which break the connection between receptacles of the second set. In practice, there could be more such circuit-breaking receptacles. Also, there could be more or fewer monitoring receptacles, similar to receptacle C. Furthermore, the pattern of receptacles on the right side of FIG. 4 is shown as only one example of many possible configurations.

Figure 1:
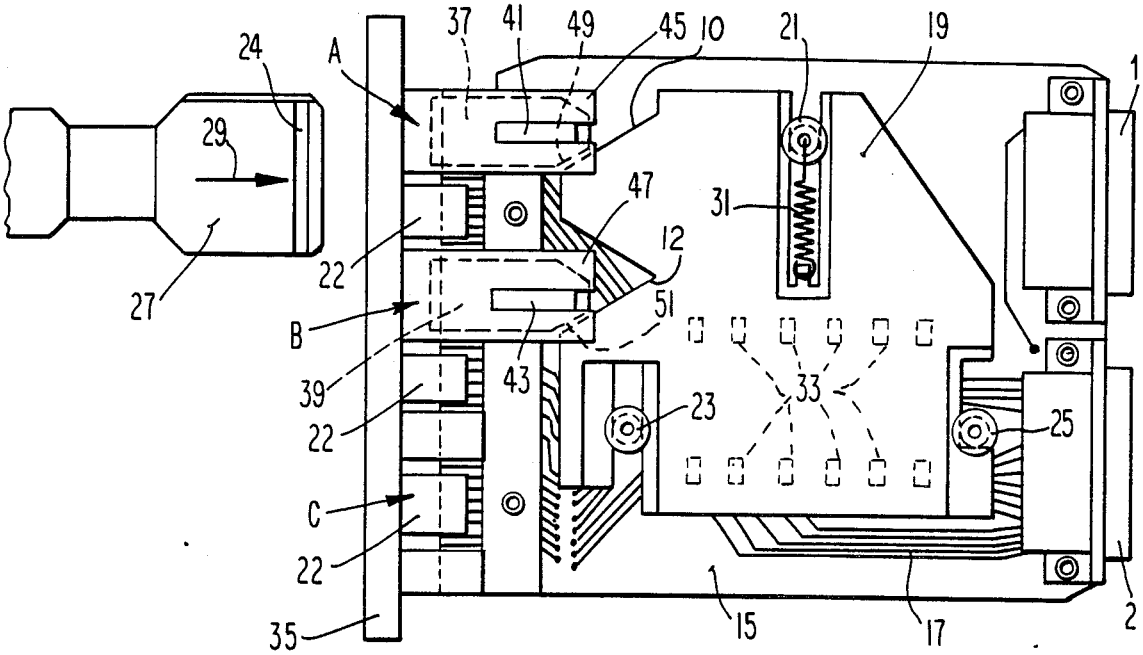
FIG. 1 is a plan view of the patch module of the present invention, showing a plug about to be inserted into one of the receptacles on the module.

FIG. 1 shows a plan view of the patch module of the present invention. Receptacles A, B, and C, and also 1 and 2, are the same as the similarly designated receptacles of FIG. 4.

The patch module is mounted on printed circuit board 15. Some of the wiring on the board 15 is indicated by reference numeral 17, but no attempt has been made, in FIG. 1, to illustrate all of the connections on the board. Instead, the electrical connections are shown schematically in FIG. 4.

A slidable panel 19 is mounted on board 15. Panel 19 is held in place on the board by pins 21, 23, and 25. Note that these pins are positioned to allow panel 19 to slide only in a direction generally perpendicular to the direction of insertion of plug 27. Plug 27 is inserted as indicated by arrow 29.

Panel 19 is held in the position shown in FIG. 1 by spring 31. FIG. 1 also shows, in dotted outline, some of the switch contacts 33 of the panel. These contacts are hidden in the view of FIG. 1; one such contact will be described later in more detail, with reference to FIG. 3. The contacts make and break circuits on the circuit board 15. The precise shape of the contacts is not critical to this invention.

Molding 35 defines a plurality of sockets for the insertion of plugs, there being three such sockets shown in FIG. 1. Latches 22 are attached to the molding, and are designed to engage groove 24 in plug 27.

Figure 5:
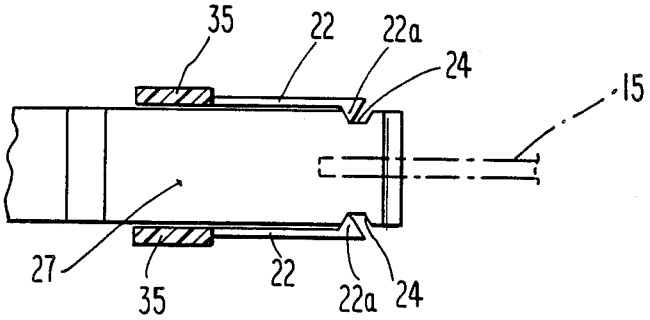
FIG. 5 is a cross-sectional view of the latching mechanism for the patching plug, taken along the line 5—5 of FIG. 2.

The latches are more clearly shown in the cross-sectional view of FIG. 5, in which plug 27 is shown in engagement with printed circuit board 15. Latches 22 have projections 22*a* which engage groove 24 in plug 27. The latches, like molding 35, are preferably formed of plastic, and are sufficiently resilient that they can bend when the plug is inserted and removed.

Figure 2:
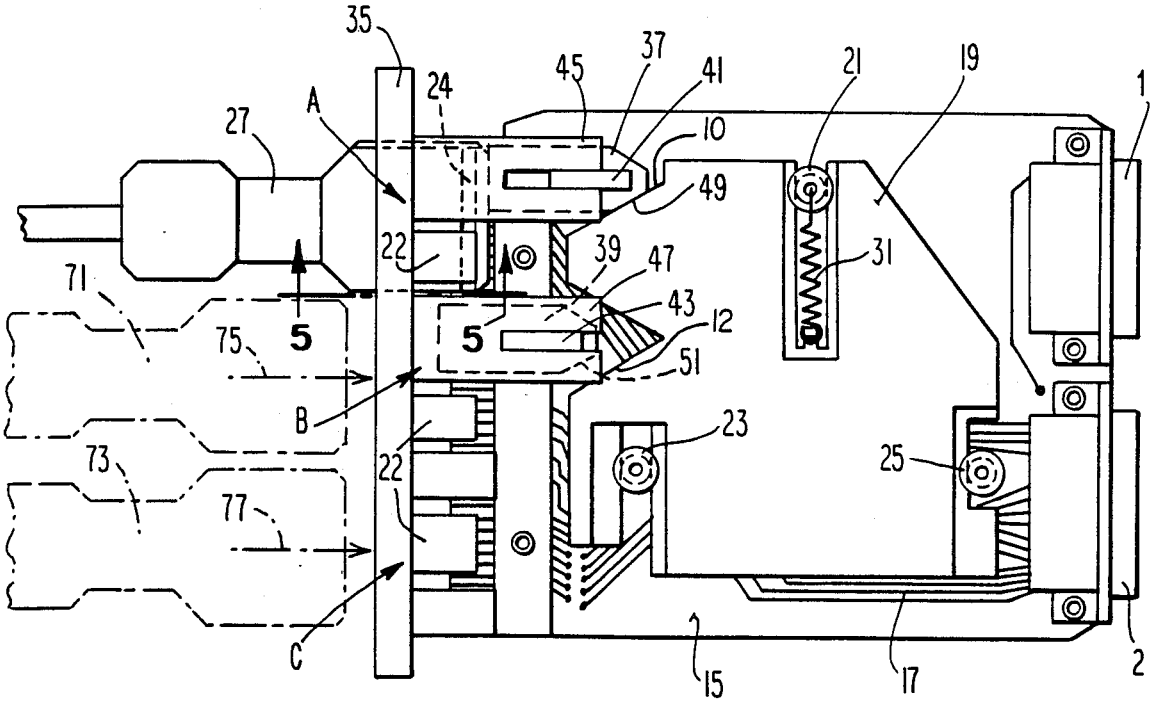
FIG. 2 is a plan view of the patch module of the present invention, after the plug has been inserted, showing the panel in a position which breaks the connection between the receptacles on the right hand side of the figure.

Mounted within the sockets for receptacles A and B are tab means 37 and 39, shown in FIGS. 1 and 2. The tab means have guides 41 and 43, respectively. The guides slide within housings 45 and 47, the housings defining slots through which the guides can slide.

The tab means 37 and 39 include beveled surfaces 49 and 51. These beveled surfaces are angled to correspond with similar beveled surfaces on panel 19 designated by reference numerals 10 and 12, respectively.

When plug 27 is inserted into receptacle A, as shown in FIG. 2, the plug pushes tab means 37 to the right. Guide 41 slides through the slot defined by housing 45, and the beveled surface 49 of tab means 37 abuts the similarly angled surface of panel 19. The pressure exerted on panel 19, from plug 27, causes the panel to slide downward, as viewed in FIG. 2. That is, panel 19 moves in a direction generally perpendicular to that of the incoming plug. That is the only direction in which the panel is free to move.

As the plug is inserted, its contacts slide over similar contacts on the printed circuit board. The cam action of the tabs is such that the distance traveled by the plug, from the point at which it first touches the tab to its final inserted position, is greater than the distance traveled by the panel. Therefore, the module creates a mechanical advantage whereby the plug can very easily overcome the spring force of the panel. In other words, the panel can be moved a short distance by exerting a relatively small force, on the plug, over a longer distance. When the plug is fully inserted, latches 22 engage the grooves in the plug, and prevent the plug from becoming dislodged by the spring-biased panel.

When panel 19 moves downward, as viewed in FIGS. 1 and 2, it breaks the connection between receptacles 1 and 2. The means by which the connection is broken are not visible in FIG. 2. Any conventional means for breaking the connection can be employed. One example of such circuit-breaking means is shown in FIG. 3.

Figure 3:
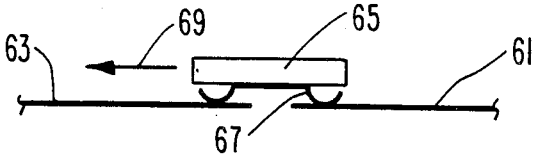
FIG. 3 is an end view showing one of the contacts of the panel of the patch module, as it completes a connection on a printed circuit board.

In FIG. 3, reference numerals 61 and 63 designate a pair of conductors in a printed circuit board, the conductors being aligned to define a gap. When this gap is closed, the conductors are electrically connected. FIG. 3 shows metallic contact 67, mounted on carrier 65. The carrier is preferably made of an insulating material. It is understood that there would be many similar carrier and contact assemblies, for the other conductors associated with a given receptacle. All of these would be mounted on the printed circuit board, and the carriers would be affixed to the slidable panel (not shown in FIG. 3). When carrier 65 is in the position shown in FIG. 3, contact 67 completes the connection between conductors 61 and 63. When carrier 65 has been moved sufficiently in the direction indicated by arrow 69, the connection between conductors 61 and 63 is broken.

It is understood that there is a separate such carrier and contact assembly, for each of the conductors connecting receptacles 1 and 2 on the printed circuit board. It is also understood that the carriers are affixed to the slidable panel (not shown in FIG. 3).

The means for making and breaking the connections between the conductors of receptacles 1 and 2 can take other forms. The specific structure for making and breaking the connections is not critical to this invention. What is important is that the sliding panel which makes and breaks the connections be slidable in a direction generally perpendicular to that of the incoming plug.

FIG. 2 also shows, in phantom, two additional plugs 71 and 73, about to be inserted into receptacles B and C, respectively, as indicated by arrows 75 and 77. Receptacle B is equipped with tab means 39, which operates in exactly the same way as tab means 37 for receptacle A. However, once panel 19 has already been moved, by insertion of plug 27 into receptacle A, the panel will not move further when another plug is inserted into receptacle B. Although the tab means 39 will still be moved to the right by insertion of plug 71, the insertion of this second plug will have no effect on the position of the panel. Tab means 39 will come to rest in abutment with the panel, without exerting any more force against the panel.

Conversely, if the first plug is inserted into receptacle B, instead of receptacle A, then tab means 39 will move panel 19 so as to disconnect receptacles 1 and 2 from each other. If a plug is then inserted into receptacle A, there will be no further effect on panel 19. The panel will return to its original position only when the plugs are removed from both receptacles A and B.

Receptacle C does not have a tab means similar to those for receptacles A and B. Insertion of a plug into receptacle C has no effect on the movement of panel 19, and does not make or break the connection between receptacles 1 and 2.

The structure described above permits the patching plugs 27 or 71 to be inserted into the patch module with very little force, due to the mechanical advantage described. The plugs are not inserted directly against the force of a spring, but instead push the panel in a direction generally perpendicular to that of the motion of the plug, through cam action. Therefore, the size and strength of the spring can be reduced, by contrast with the springs used in the prior art. The simple latch structure shown above suffices to hold the plug securely against the force of the panel. The plug can be dislodged only by pulling it out. The patch module of the present invention is therefore easy to use, more reliable, and less expensive to build than the devices previously known.

While the invention has been described with respect to one particular embodiment, it is understood that many other variations of the invention are possible. As explained above, the choice of the two circuit-breaking receptacles A and B and one monitoring receptacle C is quite arbitrary. There could be as few as one receptacle on this side of the module, or there could be many more. There could also be a series of pairs of receptacles, on the right side of the module, if desired. The means by which electrical connections are made and broken is not critical, and many different switching means could be used.

Moreover, the specific structure of the tab means and their guides could also be modified within the spirit of the invention. And the pattern of connection of receptacles can be changed. For example, receptacle A could be connected to receptacle 2, and so on. These and other similar modifications should be deemed within the spirit and scope of the following claims.

What is claimed is:

1. In a patch module, the module comprising first and second sets of receptacles, the first set having three receptacles and the second set having two receptacles, both of said sets of receptacles being mounted on a printed circuit board, the printed circuit board having electrical connections which join the conductors of the first receptacle of said first set with the conductors of the first receptacle of said second set, and which join the conductors of the second receptacle of said first set with the conductors of the second receptacle of said second set, the module including a panel which is movably mounted to and slidable along the printed circuit board, the panel having contact means for completing an electrical connection, on the printed circuit board, between the conductors of the first receptacle of said second set and the conductors of the second receptacle of said second set, the panel being connected to a spring means biasing the panel, such that the conductors of said first and second receptacles of said second set are normally electrically connected together, wherein the improvement comprises tab means, slidably mounted within both the first and second receptacles of said first set, the tab means being slidable towards the panel in response to pressure from a plug inserted into the receptacle, wherein the panel is movable in a direction generally perpendicular to that of the tab means, and wherein the panel includes a cam surface which abuts the tab means, wherein movement of the tab means, towards the cam surface of the panel, causes the panel to move in a direction generally perpendicular to that of the tab means, the angle of the cam surface being such that the distance traveled by the panel is less than the distance traveled by the plug, whereby the panel slides along the board and breaks the electrical connection between said first and second receptacles of said second set upon insertion of a plug into either one of the receptacles of said first set.

2. The improvement of claim 1, wherein the receptacles of the first set include latch means, and wherein the plug has at least one groove, the latch means having a projection for engaging the groove.

3. The improvement of claim 1, wherein the tab means includes a beveled surface which is angled for abutment with a similar surface defined by the panel.

4. The improvement of claim 3, wherein the tab means is mounted for movement within a housing, the housing being mounted on the patch module, the housing defining a slot, the tab means including a guide means which is slidable through the slot.

5. The improvement of claim 4, wherein at least one of the receptacles in said first set does not have a tab means, and wherein the conductors of said receptacle are electrically connected to the conductors of at least one of the other receptacles on the module.

6. In a patch module, the module comprising at least one first receptacle and at least two second receptacles, all of the conductors of said receptacles being connectable to a printed circuit board, the printed circuit board having electrical connections which join the conductors of the first receptacle with the conductors of one of said second receptacles, the module including a panel which is movably mounted to and slidable along the printed circuit board, the panel having contact means for completing an electrical connection, on the printed circuit board, between the conductors of said second receptacles, the panel being connected to a spring means biasing the panel, such that the conductors of said second receptacles are normally electrically connected together, wherein the improvement comprises tab means, slidably mounted within said first receptacle, the tab means being slidable towards the panel in response to pressure from a plug inserted into the first receptacle, wherein the panel is movable in a direction generally perpendicular to that of the tab means, and wherein the panel includes a cam surface which abuts the tab means, wherein movement of the tab means, towards the cam surface of the panel, causes the panel to move in a direction generally perpendicular to that of the tab means, whereby the panel slides along the board and breaks the electrical connection between said second receptacles, upon insertion of a plug into said first receptacle.

7. The improvement of claim 6, wherein the plug has a groove, and wherein the first receptacle includes a latch means, the latch means having a projection adapted to engage the groove.

8. The improvement of claim 6, wherein the tab means includes a beveled surface which is angled for abutment with a similar surface defined by the panel.

9. The improvement of claim 8, wherein the tab means is mounted for movement within a housing, the housing being mounted on the patch module, the housing defining a slot, the tab means including a guide means which is slidable through the slot.

10. The improvement of claim 9, wherein the angle of the surfaces of the tab means and the angle of the cam surface of the panel are chosen so that the distance traveled by the panel is less than the distance traveled by the plug, from the point at which the plug first engages the tab means.

11. The improvement of claim 10, further comprising a third receptacle, the conductors of the third receptacle being electrically connected to those of said first receptacle, wherein the third receptacle is free of any means for mechanical engagement with the panel, whereby insertion of a plug into the third receptacle has no effect on the motion of the panel.

12. In a patch module, the module comprising at least one first receptacle and at least two second receptacles, the first receptacle being adapted to receive a plug inserted in a first direction, all of the conductors of said receptacles being connectable to a printed circuit board, the printed circuit board having electrical connections which join the conductors of the first receptacle with the conductors of one of said second receptacles, the module including circuit-breaking means which is movably mounted to and slidable along the printed circuit board, the circuit-breaking means having contact means for completing an electrical connection, on the printed circuit board, between the conductors of said second receptacles, the circuit-breaking means being connected to a spring means biasing the circuit-breaking means, such that the conductors of said second receptacles are normally electrically connected together, wherein the improvement comprises means operable by a plug inserted into the first receptacle, for moving the circuit-breaking means in a second direction, said second direction being generally perpendicular to said first direction, wherein movement of the circuit-breaking means, in the second direction, breaks the electrical connection between the second receptacles.

13. The improvement of claim 12, wherein the means for moving the circuit-breaking means comprises tab means, slidably mounted within said first receptacle, the tab means being slidable towards the circuit-breaking means in response to pressure from a plug inserted into the first receptacle.

14. The improvement of claim 13, wherein the circuit-breaking means includes a cam surface which abuts the tab means, wherein movement of the tab means, towards the circuit-breaking means, causes the circuit-breaking means to move in a direction generally perpendicular to that of the tab means, whereby the circuit-breaking means slides along the board and breaks the electrical connection between said second receptacles, upon insertion of a plug into said first receptacle.

15. The improvement of claim 14, wherein the tab means includes a beveled surface which is angled for abutment with a similar surface defined by the circuit-breaking means.

16. The improvement of claim 15, wherein the tab means is mounted for movement within a housing, the housing being mounted on the patch module, the housing defining a slot, the tab means including a guide means which is slidable through the slot.

17. The improvement of claim 16, further comprising a third receptacle, the conductors of the third receptacle being electrically connected to those of said first receptacle, wherein the third receptacle is free of any means for mechanical engagement with the panel, whereby insertion of a plug into the third receptacle has no effect on the motion of the circuit-breaking means.

18. A patch module, comprising:

(a) first and second sets of receptacles, mounted on a printed circuit board, the first set having at least one receptacle, and the second set having at least two receptacles, (b) the printed circuit board having electrical connections which join the conductors of the first receptacle of said first set with the conductors of the first receptacle of said second set, and which join the conductors of the second receptacle of said first set with the conductors of the second receptacle of said second set, (c) a slidable panel, mounted on the printed circuit board, the panel having contact means for completing an electrical connection, formed on the board, between the conductors of the first receptacle of said second set and the conductors of the second receptacle of said second set, the panel being connected to a spring means biasing the panel, such that the conductors of said first and second receptacles of said second set are normally electrically connected together, and (d) tab means, slidably mounted within both the first and second receptacles of said first set, the tab means being slidable in the direction of the panel in response to pressure from a plug inserted into the receptacle, wherein the panel is movable in a direction generally perpendicular to that of the tab means, and wherein the panel includes a cam surface which abuts the tab means, wherein movement of the tab means, towards the cam surface of the panel, causes the panel to move in a direction generally perpendicular to that of the tab means, whereby the panel slides along the board and breaks the electrical connection between said first and second receptacles of said second set upon insertion of a plug into either one of the receptacles of said first set.

19. The module of claim 18, wherein the tab means includes a beveled surface which is angled for abutment with the cam surface of the panel.

20. The module of claim 19, wherein the tab means is mounted for movement within a housing, the housing being mounted on the patch module, the housing defining a slot, the tab means including a guide means which is slidable through the slot.

21. The module of claim 20, wherein at least one of the receptacles in said first set does not have a tab means, and wherein the conductors of said receptacle are electrically connected to the conductors of at least one of the other receptacles on the module.

22. The module of claim 21, wherein the plug has a groove means, and wherein the receptacles of the first set include a latching means, the latching means including at least one projection adapted to engage the groove means.

* * * * *

US004705921B1

REEXAMINATION CERTIFICATE (1870th)

United States Patent [19]

[11] B1 4,705,921

Rabey et al.

[45] Certificate Issued Dec. 8, 1992

[54] PATCH MODULE

[75] Inventors: Alexander Rabey, Hatboro; Herbert J. Hampel, Feasterville, both of Pa.

[73] Assignee: Vir, Inc., Southampton, Pa.

Reexamination Request:
No. 90/002,635, Feb. 12, 1992

Reexamination Certificate for:

| | |
|---|---|
| Patent No.: | 4,705,921 |
| Issued: | Nov. 10, 1987 |
| Appl. No.: | 901,053 |
| Filed: | Aug. 26, 1986 |

[51] Int. Cl.[5] ..... H01H 9/20; H01R 33/96
[52] U.S. Cl. ..... 200/50 B; 200/51.09; 200/51.1
[58] Field of Search ..... 200/1 A, 1 R, 50 B, 200/51.03, 51.1, 51.09, 51

[56] References Cited

U.S. PATENT DOCUMENTS

| | | | |
|---|---|---|---|
| 4,037,186 | 7/1977 | Palmer et al. | 335/206 |
| 4,238,655 | 12/1980 | Vonder | 200/1 A |
| 4,363,941 | 12/1982 | Nelson | 200/1 R |
| 4,476,357 | 10/1984 | Malmborg et al. | 200/51.09 |

OTHER PUBLICATIONS

Data Communications Source Book & Catalogue.85; Glasgal Communications, Inc.; vol. 1, 1985.
Data Communications—Buyer's Guide Issue 1985; McGraw-Hill, Inc.; mid-Dec., 1984; p. 60.
Data Communications; McGraw-Hill, Inc.; Mar. 1985, p. 152.
Interface 85 Program and Exhibits Guide; Business Week and Data Communications; Mar. 4, 1985; p. 147.
The Mechanical Engineers Pocketbook; William Kent; John Wiley & Sons, Inc.; (1916), p. 537.

*Primary Examiner*—A. D. Pellinen

[57] ABSTRACT

A patch module is disclosed, into which a plug can be easily inserted. In the preferred embodiment, the patch module has two sets of receptacles, the first set having three receptacles and the second set having two receptacles. Both sets are mounted on a printed circuit board which makes the desired electrical connections. The first receptacle of the first set is permanently connected to the first receptacle of the second set. The second receptacle of the first set is permanently connected to the second receptacle of the second set. The conductors of the first and second receptacles of the second set are normally connected together by contacts on a spring-biased, slidable panel, the panel being mounted for movement along the circuit board. When a plug is inserted into one of the first two receptacles of the first set, the panel slides to its other position, breaking the connection between the first and second receptacles of the second set. The panel slides in a direction generally perpendicular to that of the plug, through the cam action of a tab which is pushed by the plug. While being inserted, the plug travels a greater distance than the distance traveled by the panel, thus creating a mechanical advantage. The plug can easily be inserted against the spring force, and a simple latch is sufficient to insure that the spring-biased panel will not push the plug out of its socket.

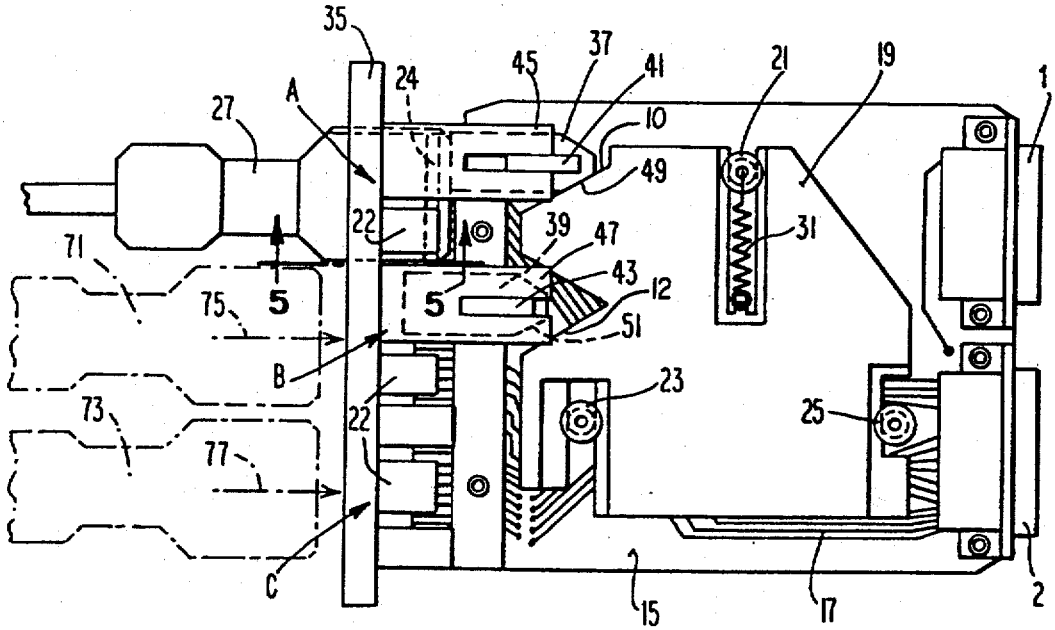

REEXAMINATION CERTIFICATE ISSUED UNDER 35 U.S.C. 307

NO AMENDMENTS HAVE BEEN MADE TO THE PATENT.

AS A RESULT OF REEXAMINATION, IT HAS BEEN DETERMINED THAT:

The patentability of claims 1-22 is confirmed.

* * * * *